United States Patent [19]

Gupta et al.

[11] Patent Number: 4,704,223

[45] Date of Patent: Nov. 3, 1987

[54] SUPERFATTED SOAPS

[75] Inventors: Shyam K. Gupta, Scottsdale; Julian R. Story, Fountain Hills, both of Ariz.

[73] Assignee: Armour-Dial, Inc., Phoenix, Ariz.

[21] Appl. No.: 894,445

[22] Filed: Aug. 1, 1986

Related U.S. Application Data

[63] Continuation of Ser. No. 749,324, Jun. 27, 1985, abandoned.

[51] Int. Cl.[4] ..... C11D 9/26; C11D 9/48; C11D 17/00

[52] U.S. Cl. ..... 252/132; 252/108; 252/134; 252/368; 252/DIG. 16

[58] Field of Search ..... 252/108, 132, 134, 368

[56] References Cited

U.S. PATENT DOCUMENTS

| | | | |
|---|---|---|---|
| 3,694,367 | 9/1972 | Peters | 252/121 |
| 3,926,829 | 12/1975 | Smith | 252/132 |
| 3,988,255 | 10/1976 | Seiden | 252/107 |
| 4,310,433 | 1/1982 | Stiros | 252/132 |
| 4,493,786 | 1/1985 | Joshi | 252/368 |

FOREIGN PATENT DOCUMENTS

| | | | |
|---|---|---|---|
| 146697 | 4/1948 | Australia | 252/132 |
| 872754 | 6/1971 | Canada . | |
| 939226 | 1/1974 | Canada . | |
| 59-161498 | 9/1984 | Japan . | |
| 59-219399 | 12/1984 | Japan . | |
| 1240105 | 7/1971 | United Kingdom | 252/108 |

OTHER PUBLICATIONS

Davidsohn, J., et al.: Soap Manufacture, vol. 1, published by Interscience Publishers, New York, 1953, pp. 295–301.

*Primary Examiner*—Dennis L. Albrecht

*Attorney, Agent, or Firm*—Frank T. Barber; Richard G. Harrer; Bernard L. Howard

[57] ABSTRACT

Toilet soap bars superfatted with branched chain fatty acids having from about 8 to 12 carbon atoms and where the branching occurs at the carbon position alpha to the carboxyl group.

5 Claims, No Drawings

SUPERFATTED SOAPS

This application is a continuation of application Ser. No. 749,324 filed June 27, 1985, now abandoned.

BACKGROUND OF THE INVENTION

This invention relates to superfatted soaps and more particularly to soaps which have been superfatted by the use of certain fatty acids whereby the lathering of the superfatted soap is enhanced and the tendency of the soap to become rancid is reduced. The superfatted soap is preferably of toilet quality in the form of bars.

Soaps employing superfatting agents of many kinds are known in the art and are commercially available. Such superfatting agents can include lanolin, higher fatty alcohols, mineral oils and higher fatty acids. The use of free fatty acids as a superfatting agent in soap is described in U.S. Pat. No. 3,576,749 to Megson. According to this patent, the presence of free fatty acids such as lauric, palmitic, stearic, oleic and others in the soap product improves the volume and quality of lather, causing it to be more stable with smaller air bubbles which give a lather characterized as richer and creamier, and is also alleged to tend to soften skin. Thus the incorporation of free fatty acids into a soap bar is desirable in that it helps eliminate free alkali, lowers the pH and may make the soap milder. It is also indicated to improve the lathering characteristics of the bar.

Our studies indicate that the customary free fatty acids added to soaps as a superfatting agent and the soap molecules reach an equilibrium distribution by migration. This migration tends to be in the direction of the free fatty acid portion having a composition similar to that of the total soap. For example, consider a soap base consisting of 70 parts sodium tallowate and 30 parts sodium cocoate to which has been added 10% by weight of coco fatty acids as a superfatting agent. The coco fatty acids normally contain about 50% of lauric acid ($C_{12}$). After the soap was processed and allowed to stand for a period, analysis of the free fat portion of the soap showed that the lauric acid content had dropped from about 50% to about 17.6% which is about the lauric acid content of the entire soap product. Analysis of the free fat of this same soap base also showed that the unsaturated fatty acid portion (oleic acid) had increased from an initial 5% to about 42.3%. The tallow portion of such a 70/30 ratio tallow/coco base contains about 42% of oleic acid.

Thus, by migration, the free fat portion of a soap made with tallow fatty acids, when superfatted with a fatty acid such as coco, could contain a large amount of unsaturated fatty acids such as oleic, linoleic and linolenic, all of which are particularly prone to rancidity.

We have also found that with a soap base consisting of 90 parts by weight sodium laurate soap and 10 parts by weight oleic acid as the superfatting agent, an analysis of the superfatting agent after a period of time shows a mixture of free lauric and free oleic acid in about a 9:1 ratio. This shows that by virtue of migration, the ratio of free oleic and free lauric acid in the superfatting agent is about the same as in the original mixture, that is, 90 parts of sodium laurate with 10 parts of oleic acid. Thus, migration causes a distribution of fatty acid chains similar to that of the overall soap product even though the acid used to superfat the soap has a different distribution. This migration is about the same whether the free fatty acid is added to the finished soap pellets or to the neat soap.

This migration of fatty acids can be a problem. Since tallow fatty acids are a prime acid source for producing soaps and tallow fatty acid is composed mainly of oleic, linoleic and linolenic acid which are unsaturated acids, through migration there will be a greater proportion of oleic acid in the superfatting agent, and this can lead to rancidity problems.

SUMMARY OF THE INVENTION

We have discovered that the problems associated with the migration of fatty acids in a soap containing free fatty acids as an additive or as a superfatting agent may be substantially reduced or eliminated entirely by employing as the superfatting agent organic acids which have a lower acidity, or higher $pK_a$, than the acids used to form the soaps themselves. For this purpose we have discovered that branched chain fatty acids having from about 8 to 20 carbon atoms and where the branching occurs at the carbon position alpha to the carboxyl group are suitable. Examples of such branched chain fatty acids include ethyl octanoic, ethyl decanoic and ethyl hexanoic as well as the rosin acids such as abietic, dehydroabietic and dihydroabietic acid, all of which work well as superfatting agents in soap products. We also find that the presence of such branched chain acids seems to enhance lathering of the finished soap product.

Thus the incorporation of such branched chain fatty acids in soaps made from tallow and/or coco fatty acids provides an excellent superfatting agent which does not migrate and thus will not become rancid through oxidation; that is, liberation of unsaturated acids such as oleic, linoleic or linolenic is greatly reduced or eliminated.

It is known from U.S. Pat. Nos. 3,793,214 and 3,926,828 that branched chain $C_5$–$C_{18}$ saturated aliphatic monocarboxylic acids including 2-ethyl hexanoic acid, can be employed in transparent soap products to aid in maintaining the transparency and glossy surface appearance of such soaps. These references disclose that from about 10 to 20 parts by weight based on the total weight of the soap base comprises such a branched chain $C_5$–$C_{18}$ saturated acid. However, these references do not disclose the use of similar branched chain fatty acids in free form as a superfatting agent for soaps, the branched chain acids as used in accordance with the teachings of these two patents being neutralized preferably through the use of a combination of sodium hydroxide and triethanolamine.

In addition, U.S. Pat. Nos. 2,628,195 and 2,628,202 disclose the use of 2-ethyl hexanoic acid as an additive to a stearic or other oil-soluble soap to be used as a lubricating grease. As with the two previously mentioned patents dealing with the production of transparent soaps, these patents use the salt form of 2-ethyl hexanoic acid and the acid itself is not in a free form in the lubricating composition.

The amount of the aforesaid branched chain fatty acids to be used in soap products according to our invention will range from about 2% to about 15% by weight of the soap with about 5% to about 10% by weight being preferred. These branched chain acids may be added to the soap base in the same manner and at the same stages as is recommended by the art with respect to the customary long chain acids such as coco or tallow. We prefer to add the acids to the soap pellets.

The following soap formulations were evaluated.

EXAMPLE I

| BAR | SOAP BASE % Tallow | SOAP BASE % Coco | SUPERFATTING AGENT | % |
|---|---|---|---|---|
| A | 55.0 | 45.0 | Stripped Hydrogenated Coco* | 8.0 |
| B | 42.4 | 57.6 | Tallow Fatty Acid | 10.0 |
| C | 55.0 | 45.0 | 2-Ethyl Hexanoic | 8.0 |
| D | 49.6 | 50.4 | $C_8$–$C_{10}$ Fatty Acid | 5.8 |

*$C_8$ to $C_{10}$ fatty acids have been removed

After all bars had been stored at room temperature for a period of 7 days, the free acid portion of all bars was extracted and analyzed by gas chromatography with the following results.

| FATTY ACID #C | BAR A % | BAR B % | BAR C % | BAR D % |
|---|---|---|---|---|
| 8 | | | | 4.4 |
| 10 | | | | 2.8 |
| 12 | 19.3 | 20.9 | | 20.7 |
| 14 | 11.2 | 11.4 | | 13.2 |
| 16 | 8.5 | 8.7 | | 8.1 |
| 16-1 | 4.6 | 5.4 | | 3.7 |
| 18 | 6.7 | 4.2 | | 5.7 |
| 18-1 | 35.9 | 37.3 | | 30.2 |
| 18-2 | 10.4 | 7.3 | | 4.8 |
| 17 | | | | 1.5 |
| 2-EthylHexanoic | | | 91.3 | |
| Misc. | 3.2 | 4.6 | 8.0 | 1.6 |

It will be seen from the above that Bar C which was superfatted with 2-ethyl hexanoic acid showed almost no migration although the straight chain $C_8$–$C_{10}$ fatty acid used as the superfatting agent in Bar D showed considerably more migration.

EXAMPLE II

To evaluate the lathering performance of a soap containing 2-ethyl hexanoic acid, the following soap formulations were prepared and stamped into bars.

| BAR | SOAP BASE % Tallow | SOAP BASE % Coco | SUPERFATTING AGENT | % |
|---|---|---|---|---|
| E | 55 | 45 | Stripped hydrogenated Coco | 8 |
| F | 55 | 45 | 2-Ethyl hexanoic acid | 8 |

In evaluating the foregoing bar soaps, 8 panelists washed their hands with each of bars E and F and evaluated the bars for:

Lather speed: how quickly lather accumulates on hands.

Lather thinness: thin lather will be watery or "soupy". Thick lather will be stiff and compact; staying in a mound.

Creaminess: creamy lather has a lotion-like quality.

Bubble size: are bubbles large and fragile or small and dense?

Lather amount: quantity of lather.

Each panelist was asked to indicate which bar was preferred with respect to each characteristic.

The results of the test are as follows:

| | PREFERENCE BAR E | PREFERENCE BAR F | CONFIDENCE LEVEL |
|---|---|---|---|
| Lather Speed | 0 | 8 | 95% |
| Lather Thinness | 8 | 0 | 95% |
| Creaminess | 0 | 8 | 95% |
| Bubble Size | 6 | 2 | Not significant |
| Lather Amount | 0 | 8 | 95% |

As seen above, all of the panelists found that the soap bar superfatted with 2-ethyl hexanoic acid was significantly superior in lathering characteristics (excepting bubble size) to a soap bar superfatted with stripped hydrogenated coco fatty acids. In evaluating lather characteristics of soap we consider lather speed, creaminess and the quantity of lather to be the most important criteria.

EXAMPLE III

Bars A, B, C and D were also subjected to color stability tests. Such tests involve separately subjecting the bars to a mercury vapor light for 6 hours and ultraviolet light for 16 hours. The bars were then evaluated for color at various time intervals with the following results.

| BAR | REFLECTOMETER RATING** 2 Week | 4 Week | 8 Week | 13 Week |
|---|---|---|---|---|
| A | 7.3 | 6.6 | 5.9 | 5.4 |
| B | 7.2 | 6.4 | 5.7 | 5.2 |
| C | 7.9 | 7.5 | 7.1 | 6.5 |
| D | 7.2 | 6.2 | 5.5 | 5.0 |

**Higher numbers indicate better color stability

It will be observed that Bar C, which contained 2-ethyl hexanoic acid as the superfatting agent, has better color stability than the other formulations tested.

EXAMPLE IV

Soap bars were prepared having the following formula

| | | |
|---|---|---|
| Soap Base | sodium tallowate | 85% |
| | sodium cocoate | 15% |
| Superfatting agent | abietic acid*** | 16% |

***Available as "DR-20" from Arizona Chemical Company

After the bars had been stored at room temperature for a period of 3 days, the free acid portion of the soap was extracted and analyzed by gas chromatography. The analysis did not detect the presence of $C_8$–$C_{18}$ acids, including the unsaturated oleic, linoleic and linolenic acids.

The soaps to be employed in our invention can be characterized as water soluble salts of higher fatty acids, particularly the alkali metal salts, for example, the sodium and potassium salts, thereof. Such fatty acids in general have chain lengths comprising from 8–20 carbon atoms and predominantly from 10–18 carbon atoms. The soaps are conventionally prepared by the saponification of alkaline materials of a mixture of tallow-class fats and oils. Sodium and potassium soaps can be prepared by direct saponification of fats and oils or by the neutralization of the free fatty acids which are prepared in a separate manufacturing process. Particularly useful are the sodium and potassium salts of mixtures of fatty acids derived from coconut oil and tallow, i.e., sodium and potassium tallowate and/or cocoate. The invention is particularly useful in soaps which contain a proporation of sodium tallowate since the tallowate has a higher percentage of unsaturated fatty acids. That is, the problem of migration is greater in sodium tallowate soaps.

The amount of alpha branched fatty acid used as the superfatting agent in soaps can range from 2 to 15 percent. Preferably from about 5 to 10 percent.

From the foregoing examples we see that the incorporation of alpha branched fatty acids having from about 8 to 20 carbon atoms into soap increases both its stability and lathering.

What is claimed is:

1. A superfatted soap composition in bar form comprising the water soluble salts of higher fatty acids having from 8–20 carbon atoms, said soap composition containing as a superfatting agent from about 2% to about 15% by weight of said soap of a branched chain aliphatic monocarboxylic acid having from 8–12 carbon atoms and wherein the branching of the carbon chain of said acid occurs at the carbon position alpha to the carboxyl group.

2. The soap composition of claim 1 wherein the amount of said superfatting agent ranges from about 5% to about 10% by weight of said soap composition.

3. The soap composition of claim 1 wherein the superfatting agent is 2-ethyl hexanoic acid.

4. The soap composition of claim 1 wherein the superfatting agent is 2-ethyl octanoic acid.

5. The soap composition of claim 1 wherein the superfatting agent is 2-ethyl decanoic acid.

* * * * *